US007445454B2

(12) United States Patent
Szu et al.

(10) Patent No.: US 7,445,454 B2
(45) Date of Patent: Nov. 4, 2008

(54) ELECTRICAL CONNECTOR ASSEMBLY WITH IMPROVED PICK UP CAP

(75) Inventors: Ming-Lun Szu, Tu-Cheng (TW); Fu-Pin Hsieh, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/981,147

(22) Filed: Oct. 31, 2007

(65) Prior Publication Data

US 2008/0102651 A1 May 1, 2008

(51) Int. Cl.
*H01R 13/60* (2006.01)

(52) U.S. Cl. ..... 439/41; 439/940

(58) Field of Classification Search ..... 439/41, 439/940, 135, 342, 83
See application file for complete search history.

(56) References Cited

U.S. PATENT DOCUMENTS

| | | | | |
|---|---|---|---|---|
| 5,688,133 | A * | 11/1997 | Ikesugi et al. | 439/135 |
| 6,916,195 | B2 | 7/2005 | Byquist | |
| 6,969,267 | B2 | 11/2005 | Byquist | |
| 2005/0003683 | A1 | 1/2005 | Liao | |
| 2008/0038938 | A1 * | 2/2008 | Liao | 438/41 |
| 2008/0102665 | A1 * | 5/2008 | Fan | 439/135 |

* cited by examiner

*Primary Examiner*—Hae Moon Hyeon
(74) *Attorney, Agent, or Firm*—Wei Te Chung

(57) ABSTRACT

An electrical connector assembly (5) includes an electrical connector (6) and a pick up cap (7) latchably assembly to the electrical connector. The electrical connector includes an insulative housing (60) and a number of conductive contacts received in the insulative housing. The pick up cap includes a main portion (70) and at least a pair of hooks (71) extending from the main portion toward the electrical connector to latch with the electrical connector. The pick up cap forms at least a pair of protecting members (72) adjacent to corresponding hook to protect the hook from being broken by improper force.

17 Claims, 2 Drawing Sheets

ELECTRICAL CONNECTOR ASSEMBLY WITH IMPROVED PICK UP CAP

BACKGROUND OF THE INVENTION

1. Field of the Invention

The present invention generally relates to an electrical connector assembly, and more particularly to an electrical connector assembly for removably mounting a chip module to a printed circuit board.

2. Description of Related Art

With the Mechanization development of electronic components integrated manufacture, pick up caps are used in mechanical mounting process of different kinds of electronic components more widely. US Pub. No. 20050003683A1 disclosed an electrical connector assembly comprising an electrical connector and a pick up cap latchably assembled to the electrical connector. The pick up cap comprises a main portion having a smooth top surface and a plurality of hooks extending downwardly from the main portion. The hooks latch to the electrical connector to secure the pick up cap to the electrical connector. A vacuum device absorbs the smooth top surface of the pick up cap to realize the movement and position of the electrical connector.

However, the electrical connector assembly with above structures has at least the shortcomings as follows: Since the hooks often locate at opposite edges of the main portion of the pick up cap, the hooks are easy to contact with other elements and improper force is exerted to the hooks to cause the break of the hooks. Thus, the use of the pick up cap is lost and the electrical connector may be damaged.

Therefore, it is desired to provide an improved electrical connector assembly to stress the problems mentioned above.

BRIEF SUMMARY OF THE INVENTION

Accordingly, an object of the present invention is to provide an electrical connector assembly with improved structure for protecting hooks of a pick up cap thereof.

In order to achieve the above-mentioned object, an electrical connector assembly comprises an electrical connector and a pick up cap latchably assembly to the electrical connector. The electrical connector comprises an insulative housing and a plurality of conductive contacts received in the insulative housing. The pick up cap comprises a main portion and at least a pair of hooks extending from the main portion toward the electrical connector to latch with the electrical connector. The pick up cap forms at least a pair of protecting members adjacent to corresponding hook to protect the hook from being broken by improper force.

Other objects, advantages and novel features of the invention will become more apparent from the following detailed description of the present embodiment when taken in conjunction with the accompanying drawings.

DETAILED DESCRIPTION OF THE INVENTION

Figure 1:
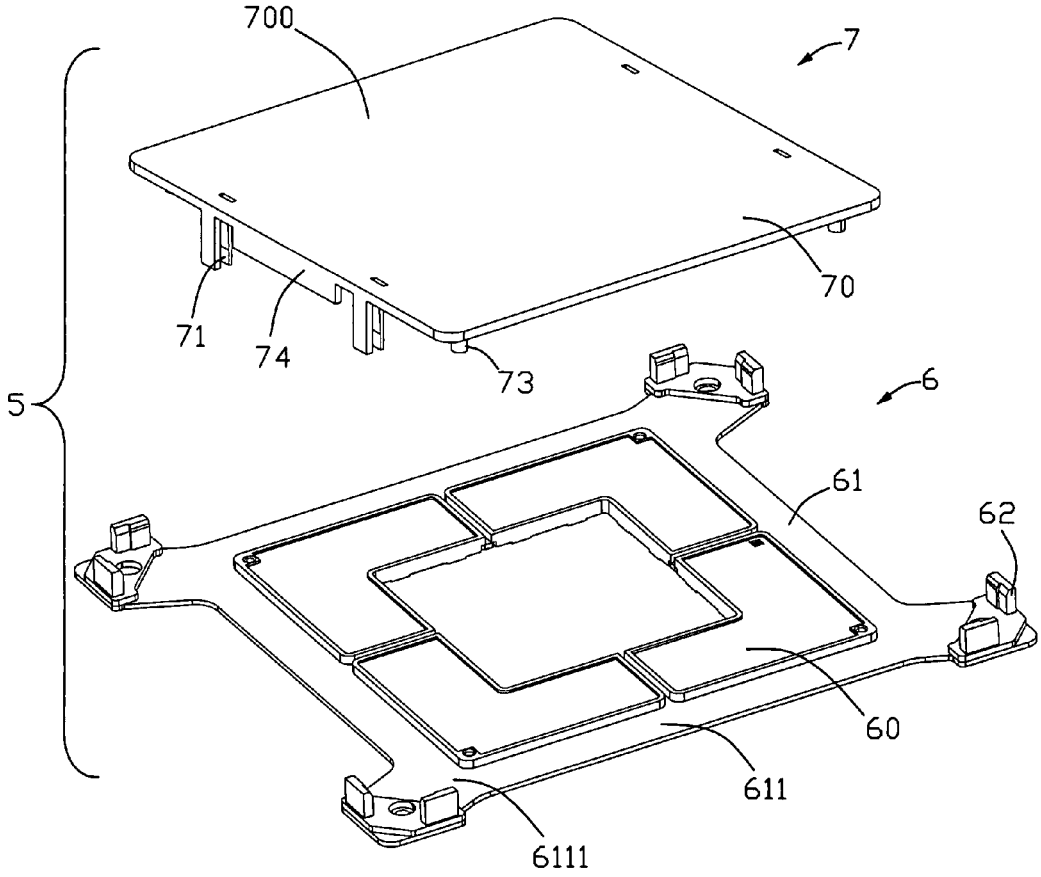
FIG. 1 is an exploded, perspective view of an electrical connector assembly in accordance with the present invention.

Reference will now be made to the drawing figures to describe the present invention in detail.

Figure 2:
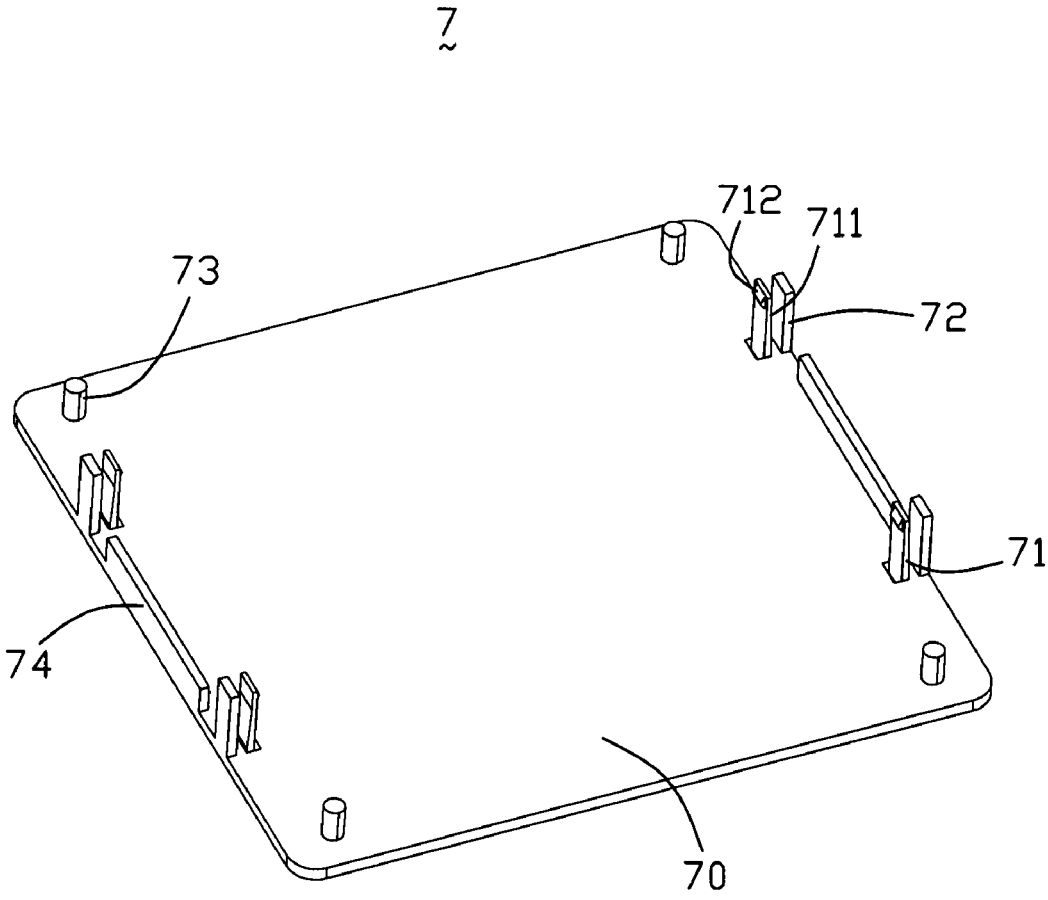
FIG. 2 is a bottom view of a pick up cap shown in FIG. 1.

Please refer to FIGS. 1-2, an electrical connector assembly 5 in accordance with the present invention for electrically connecting a chip module (not shown) to a printed circuit board (not shown) comprises an electrical connector 6 and a pick up cap 7 latchably assembled to the electrical connector 6. The electrical connector 6 comprises an insulative housing 60 assembled with a plurality of conductive contacts (not shown), a fastening frame 61 partially surrounding the insulative housing 60 and a plurality of restriction tubes 62 formed on the fastening frame 61.

The insulative housing 60 is a flat board and defines a plurality of contact-receiving slots (not shown) penetrating through opposite upper and lower surfaces thereof. Each contact-receiving slot receives a corresponding conductive contact.

The fastening frame 61 is also a flat board and comprises a plurality of side edges 611 each comprising a supporting surface 6111 equipped with the restriction tubes 62.

The pick up cap 7 is substantially of flat board and comprises a main portion 70 and a plurality of hooks 71 extending from the main portion 70 toward the electrical connector 6, and a plurality of protecting members 72 adjacent to corresponding hooks 71. In the preferred embodiment of the present invention, the protecting members 72 are protruding bars extending downwardly from opposite side edges. The height of each protecting member 72 is substantially same as that of the hook 71. Each protecting member 72 is flush with outer periphery of the main portion 70 to locate at outer side of corresponding hook 71 for preventing the hook 71 from break. Each hook 71 comprises an extension section 711 extending downwardly from the main portion 70 and a latch section 712 bending inwardly from distal end of the extension section 711. The latch section 712 latches to the fastening frame 61 to secure the pick up cap 7 to the electrical connector 6.

The pick up cap 7 forms a plurality of tubers 73 downwardly extending from the main portion 70 to abut against the electrical connector 6 to prevent the curved deformation of the pick up cap 7 toward the electrical connector 6. A pair of tongue sections 74 downwardly extend from opposite side edges of the main portion 70 to each locate between a pair of protecting members 72 for separating the pick up cap 7 from the electrical connector 6 conveniently.

In assembly, the pick up cap 7 is assembled to the electrical connector 6 via the hooks 71. Since the protecting members 72 are located adjacent to the hooks 71, the hooks 71 are prevented from being exerted with outer importer force and being broken, thus, reliable connection between the pick up cap 7 and the electrical connector 6 is achieved.

It should be pointed out that, in the preferred embodiment of the present invention, the protecting member 72 is a protruding bar located at outer side of the hook 71 with a height equal to that of the hook 71. In alternative embodiments, the protecting member 72 also can be other shapes, and locate adjacent to the hook 71 according to actual needs, and has a height not equal to that of the hook 71.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an electrical connector, comprising:

an insulative housing; and a plurality of conductive contacts received in the insulative housing; and a pick up cap latchably assembled to the electrical connector and comprising a main portion and at least a pair of hooks extending from the main portion toward the electrical connector to latch with the electrical connector; and wherein the pick up cap forms at least a pair of protecting members adjacent to corresponding hook to protect the hook from being broken by improper force.

2. The electrical connector assembly as claimed in claim 1, wherein the protecting member is a protruding bar extending downwardly form the main portion of the pick up cap.

3. The electrical connector assembly as claimed in claim 2, wherein the height of the protruding bar is substantially same as that of the hook.

4. The electrical connector assembly as claimed in claim 2, wherein the protruding bar is located at outer side of the hook.

5. The electrical connector assembly as claimed in claim 2, wherein said protruding bars are formed at opposite side edges of the pick up cap.

6. The electrical connector assembly as claimed in claim 1, wherein the hook comprises an extension section extending downwardly from the main portion and a latch section protruding outwardly from the extension section to latch with the electrical connector.

7. The electrical connector assembly as claimed in claim 6, wherein said electrical connector further comprises a fastening frame partially surrounding the insulative housing, and wherein said latch section of the hook latches with the fastening frame.

8. The electrical connector assembly as claimed in claim 1, the pick up cap forms a plurality of tubers extending from the main portion thereof toward the electrical connector to abut against the electrical connector.

9. The electrical connector assembly as claimed in claim 1, wherein said pick up cap forms a pair of tongue sections at opposite side edges for separating the pick up cap from the electrical connector conveniently.

10. The electrical connector assembly as claimed in claim 9, wherein the pick up cap forms the pair of hooks and the pair of protecting members, and wherein each tongue section is located between the pair of protecting members.

11. The electrical connector assembly as claimed in claim 2, wherein the protruding bar is parallel to the hook and has the substantially same height as that of the hook.

12. The electrical connector assembly as claimed in claim 2, wherein the outer surface of the protruding bar is substantially coplanar with that of outer edge of the pick up cap.

13. An electrical connector assembly, comprising:

an electrical connector, comprising:

an insulative housing; and a plurality of conductive contacts received in the insulative housing; and a pick up cap latchably assembled to the electrical connector and comprising a main portion and at least a hook extending from the main portion toward the electrical connector to latch with the electrical connector; and wherein the pick up cap forms at least a protecting member adjacent to corresponding hook to protect the hook from being broken by improper force.

14. The electrical connector assembly as claimed in claim 13, wherein said protecting member is laterally closer to an exterior than the hook.

15. The electrical connector assembly as claimed in claim 14, wherein said hook latches to an exterior edge of the connector.

16. The electrical connector assembly as claimed in claim 14, wherein said protecting member is located closer to a periphery of the pick up cap than the hook.

17. An electrical connector assembly, comprising:

an electrical connector, comprising:

an insulative housing; and a plurality of conductive contacts received in the insulative housing; and a pick up cap latchably assembled to the electrical connector and comprising a main portion and at least a hook extending from the main portion toward the electrical connector to latch with the electrical connector; and wherein said hook is closely accompanied with a protecting member on an exterior side of said hook for protection.

* * * * *